US009815534B2

(12) United States Patent
Diamond

(10) Patent No.: US 9,815,534 B2
(45) Date of Patent: Nov. 14, 2017

(54) DEVICE FOR INCREASING BUOYANCY OF A SNORKEL OR A SNORKEL WITH ATTACHED MASK

(71) Applicant: Joanna Elizabeth Diamond, Fort Lauderdale, FL (US)

(72) Inventor: Joanna Elizabeth Diamond, Fort Lauderdale, FL (US)

(73) Assignee: Joanna Elizabeth Diamond, Fort Lauderdale, FL (US)

( * ) Notice: Subject to any disclaimer, the term of this patent is extended or adjusted under 35 U.S.C. 154(b) by 0 days.

(21) Appl. No.: 14/827,242

(22) Filed: Aug. 14, 2015

(65) Prior Publication Data

US 2016/0046357 A1 Feb. 18, 2016

Related U.S. Application Data

(60) Provisional application No. 62/037,587, filed on Aug. 14, 2014.

(51) Int. Cl.
*B63C 11/16* (2006.01)
*B63C 11/20* (2006.01)

(52) U.S. Cl.
CPC ..... *B63C 11/207* (2013.01); *B63C 11/16* (2013.01)

(58) Field of Classification Search
CPC ..... B63C 11/16; B63C 11/20; B63C 11/207; B63C 11/02; A62B 7/00; A62B 7/02
USPC ..... 128/201.11; 441/136
See application file for complete search history.

(56) References Cited

U.S. PATENT DOCUMENTS 3,064,646 A * 11/1962 Miller ..... B63C 11/207 128/201.11
4,583,536 A * 4/1986 Jan ..... B63C 11/207 128/201.11
5,351,681 A * 10/1994 Hudson ..... B63C 11/207 128/201.11
5,606,967 A * 3/1997 Wang ..... B63C 11/16 128/200.29
5,622,165 A * 4/1997 Huang ..... B63C 11/207 128/201.11
5,893,362 A * 4/1999 Evans ..... B63C 11/207 128/200.29
6,726,516 B2 * 4/2004 Sowry ..... A63H 23/10 441/136
7,159,528 B1 * 1/2007 Hilliker ..... B63C 11/207 114/315

* cited by examiner

*Primary Examiner* — Lars A Olson
(74) *Attorney, Agent, or Firm* — Landmark Intellectual Property Law, PLLC

(57) ABSTRACT

The present invention is generally directed to a floatation device for a snorkel, including a body made from a buoyant material; and an orifice penetrating through the body, the orifice sized to receive a snorkel, such that the floatation device provides sufficient buoyancy to float a snorkel and an attached mask on the surface of water. More specifically, the body may be brightly colored and the orifice may be sized to cause an interference fit with an inserted snorkel. In accordance with some embodiments, the body may be wrapped or covered in a second material.

19 Claims, 9 Drawing Sheets

702
701
700

712
711
710

722
721
720

732
731
730

742
741
740

830
800
820
810

940
920
930
910
900

DEVICE FOR INCREASING BUOYANCY OF A SNORKEL OR A SNORKEL WITH ATTACHED MASK

RELATED APPLICATIONS

The present application claims priority to and incorporates herein by reference, U.S. Provisional Patent Application No. 62/037,587, entitled "Flotation Device for a Snorkel, or Snorkel Floatation Device, or Snorkel Float, or Snorkel Buoy, that Stops the Snorkel and Mask from Sinking," filed on Aug. 14, 2014.

BACKGROUND

In general, the present invention is directed to a device to increase the buoyancy of a snorkel or a snorkel with an attached mask, causing the snorkel or snorkel with an attached mask to float. More specifically, the present invention is directed to a floatation device into which a snorkel may be inserted.

In general, diving masks and snorkels are denser than water, causing such items to sink rather than float. This can be problematic, as the act of diving, snorkeling, and even swimming with a snorkel or snorkel with an attached mask may involve movements and interactions with water that often cause the snorkels or snorkels with attached masks to be washed off a user.

Given the environment in which masks and snorkels are generally used (i.e., deep water), snorkels and/or snorkels with attached masks that sink are often irretrievable. If a user is in an environment where the snorkel or snorkel with attached mask are needed (or highly desired), the loss of a mask and/or snorkel may be catastrophic. For example, a diver seeking to repair a cruising vessel while at sea may have a great need for a snorkel and mask. In addition, diving masks and snorkels are not inexpensive, causing such losses to have a financial impact on a user.

There are various items that attempt to address this issue, such as neoprene straps for masks which may slightly increase the buoyancy of a mask. However, such increased buoyancy generally does not result in a mask or snorkel with attached mask floating safely on the surface, but merely slows the descent of the mask and/or snorkel. Moreover, such neoprene or floating straps often get tangled in a user's hair, thereby reducing their functionality and/or desirability as a mask strap. Similarly, some manufacturers have attempted to provide masks that float. However, when a mask is manufactured from a buoyant material, the mast often becomes more flimsy and not desirable as a mask.

Accordingly, there is a need for a device that may increase the buoyancy of a snorkel or a snorkel with an attached mask such that the snorkel or snorkel with an attached mask may float safely on the surface of the water, while not impeding the use of the snorkel or mask.

SUMMARY OF THE INVENTION

In accordance with some embodiments of the present invention, aspects may include a floatation device for a snorkel, comprising: a body, comprised of a buoyant material; and an orifice penetrating through the body, the orifice sized to receive a snorkel.

In accordance with some embodiments of the present invention, other aspects may include a floatation device for a snorkel, comprising: a body, comprised of a first material wrapped in a second material, wherein the first material is buoyant and the second material is brightly colored; and an orifice penetrating through the body, the orifice sized to receive a snorkel and cause an interference fit with the snorkel.

Other aspects in accordance with some embodiments of the present invention may include a floatation device for a snorkel, comprising: a body, comprised of a brightly colored buoyant material; and an orifice penetrating through the body, the orifice sized to receive a snorkel and cause an interference fit with the snorkel, wherein the body provides buoyancy sufficient to float a snorkel and attached mask on a surface of water.

These and other aspects will become apparent from the following description of the invention taken in conjunction with the following drawings, although variations and modifications may be effected without departing from the scope of the novel concepts of the invention.

DESCRIPTION OF THE FIGURES

The present invention can be more fully understood by reading the following detailed description together with the accompanying drawings, in which like reference indicators are used to designate like elements. The accompanying figures depict certain illustrative embodiments and may aid in understanding the following detailed description. Before any embodiment of the invention is explained in detail, it is to be understood that the invention is not limited in its application to the details of construction and the arrangements of components set forth in the following description or illustrated in the drawings. The embodiments depicted are to be understood as exemplary and in no way limiting of the overall scope of the invention. Also, it is to be understood that the phraseology and terminology used herein is for the purpose of description and should not be regarded as limiting. The detailed description will make reference to the following figures, in which.

DETAILED DESCRIPTION

Figure 1:
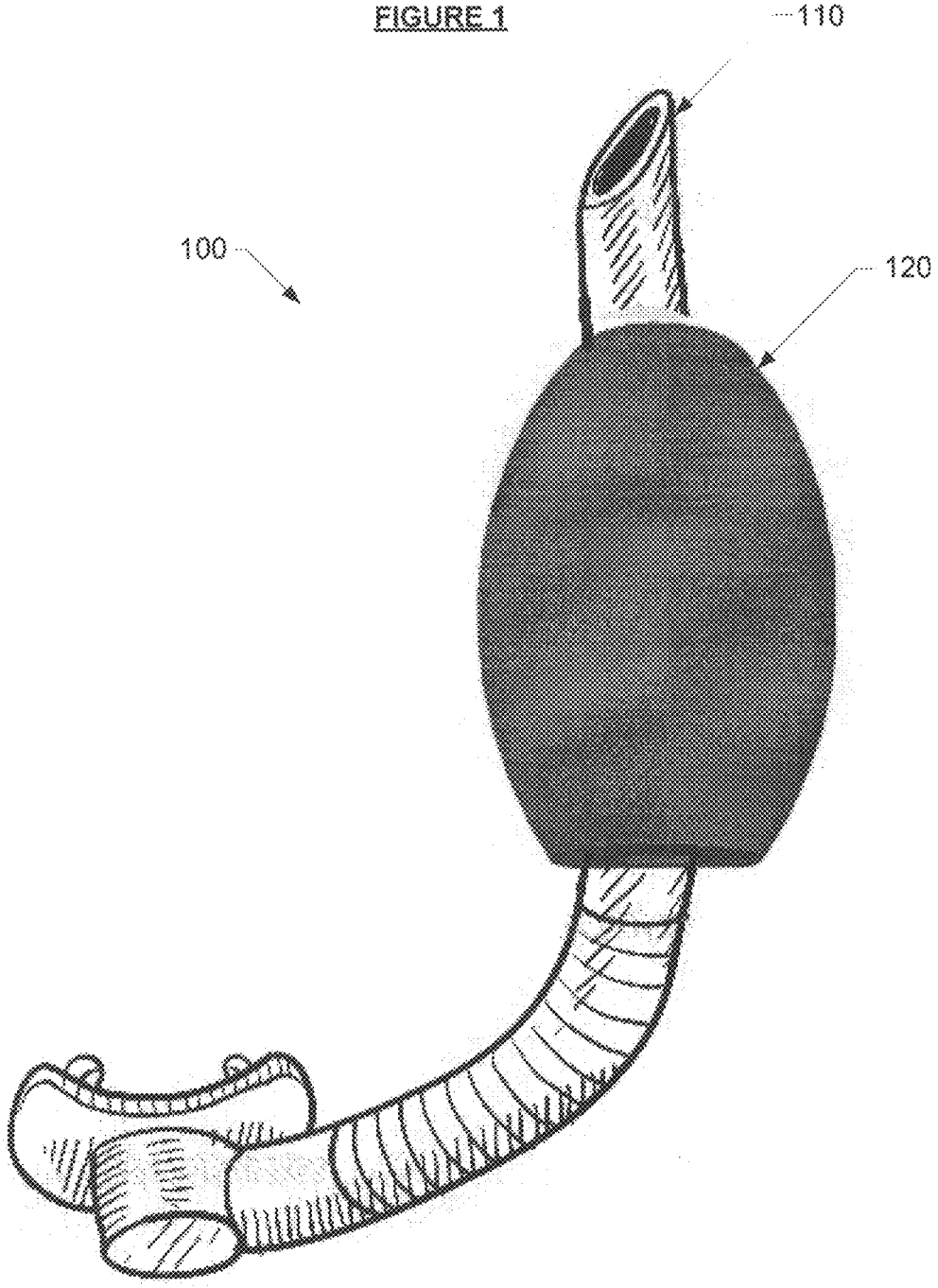
FIG. 1 illustrates an exemplary device attached to a snorkel to increase the buoyancy of a snorkel or a snorkel attached to a mask, in accordance with some embodiments of the present invention.
Figure 2:
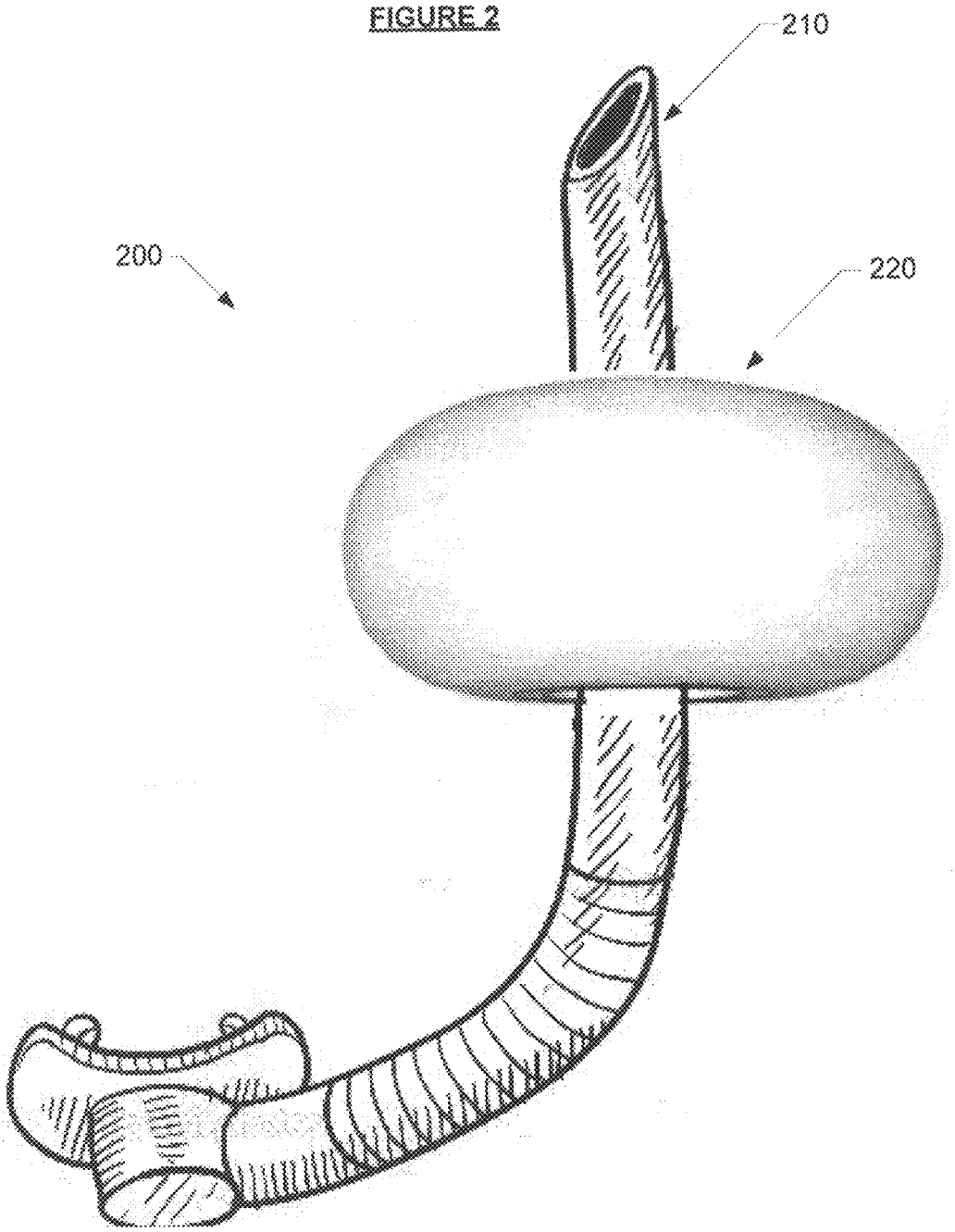
FIG. 2 illustrates an exemplary device attached to a snorkel to increase the buoyancy of a snorkel or a snorkel attached to a mask, in accordance with some embodiments of the present invention.

Before any embodiment of the invention is explained in detail, it is to be understood that the present invention is not limited in its application to the details of construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

The matters exemplified in this description are provided to assist in a comprehensive understanding of various exemplary embodiments disclosed with reference to the accompanying figures. Accordingly, those of ordinary skill in the art will recognize that various changes and modifications of the exemplary embodiments described herein can be made without departing from the spirit and scope of the claimed invention. Descriptions of well-known functions and constructions are omitted for clarity and conciseness. Moreover, as used herein, the singular may be interpreted in the plural, and alternately, any term in the plural may be interpreted to be in the singular.

In general, the present invention is directed to a snorkel floatation device, comprised of a buoyant material which may be attached to a snorkel.

It is contemplated that the snorkel buoy may be attached to a snorkel in any manner. For example, the snorkel buoy may be attached through a device, such as hook-and-loop attachments, straps, snaps, etc. In addition, and in accordance with some embodiments of the present invention, the snorkel buoy may be attached to the snorkel via an interference fit. In such embodiments, the snorkel or a portion of the snorkel may be inserted into an orifice in the snorkel buoy. The orifice in the snorkel buoy may penetrate full or only partially into the snorkel buoy.

The snorkel buoy may be comprised of a buoyant material. The buoyancy of the snorkel buoy may be sufficient to maintain a snorkel or a snorkel with an attached mask floating safely on the surface of the water. In accordance with some embodiments of the present invention, the snorkel buoy may be comprised of a closed-cell foam, such as polyethylene foam (including expanded polyethylene (EPE), polyethylene furanoate (PEF), cross-linked polyethylene (XPE), irradiation cross-linked polyethylene (IXPE), and low density polyethylene (LDPE)), polypropylene and expanded polypropylene (EPP) foam, polystyrene or expanded polystyrene foam, polyurethane foam, polyvinylchloride foam, ethylene vinyl acetate (EVA) foam, expanded polyolefin (EPO) foam, etc. In accordance with some embodiments of the present invention, the snorkel buoy may be comprised of a material that may be inflated with air to become buoyant. Such inflatable snorkel buoys may be made of any suitable materials, such as but not limited to vinyl, polyvinyl chloride (PVC), thermoplastic polyurethane (TPU), etc.

The snorkel buoy may be comprised of a single material, or may be comprised of multiple materials layered or attached to one another. For example, in accordance with some embodiments of the present invention, the snorkel buoy may be comprised of closed-cell foam wrapped in a vinyl or PVC material. Similarly, such embodiments may include a highly buoyant material layered and/or attached to a less buoyant but more durable material.

Moreover, because the snorkel buoy may be in a corrosive environment (i.e., salt water and sun exposure), the material selected may be resistant to sun and/or salt water damage. In accordance with some embodiments of the present invention, the resistant material may be an outer coating or layer of the snorkel buoy (such as waterproof resin or vinyl), while the inside portion of the snorkel buoy may be comprised of a buoyant material without regard to environmentally resistant characteristics.

Note that the snorkel buoy may be of any suitable size and/or shape. The size of the snorkel buoy may be determined based upon the snorkel or snorkel with attached mask that the buoy must float. For example, if a diver uses a particularly heaving mask, then the snorkel buoy may be larger than one used for a very light-use diving mask. Note that the snorkel buoy should not be too large. Excessive buoyancy may negatively impact a user, particularly during free diving or spear-diving.

The snorkel buoy may comprise any shape, though it is noted that the shape of the snorkel buoy may be configured to avoid interference with the use of the snorkel and/or mask, as well as to avoid unwanted interaction with the user's head and/or hair. In accordance with some embodiments of the present invention, the snorkel buoy may be generally shaped as an elongated sphere or oval. It is also contemplated that the snorkel buoy may be of a donut shape.

In accordance with some embodiments of the present invention, the snorkel buoy may be any color and may comprise any design thereon. However, it is contemplated that the color of the snorkel buoy may be bright and/or reflective to increase visibility. Increased visibility may be desirable to (i) locate a snorkel or snorkel with attached mask that is free-floating; and/or (ii) increase visibility of snorkelers on the surface of the water to boats or other people in the area. The snorkel buoy may include a pattern thereon, such as a diver down flag to increase visibility and safety of the user. In addition, it is contemplated that the snorkel buoy—or a covering of the snorkel-buoy—may be glow-in-the-dark. Again, this increased visibility may assist a user in locating a free-floating snorkel or snorkel with attached mask, as well as increase visibility of a snorkeler to any boats in the area.

In accordance with some embodiments, the snorkel buoy may be also carry an additional light source to increase visibility. For example, the snorkel buoy may be equipped to carry or attach to a light emitting diode (LED) or other light source (such as via chemical luminescence or chemiluminescence device—such as a glow stick) to assist with night-time visibility.

Figure 3:
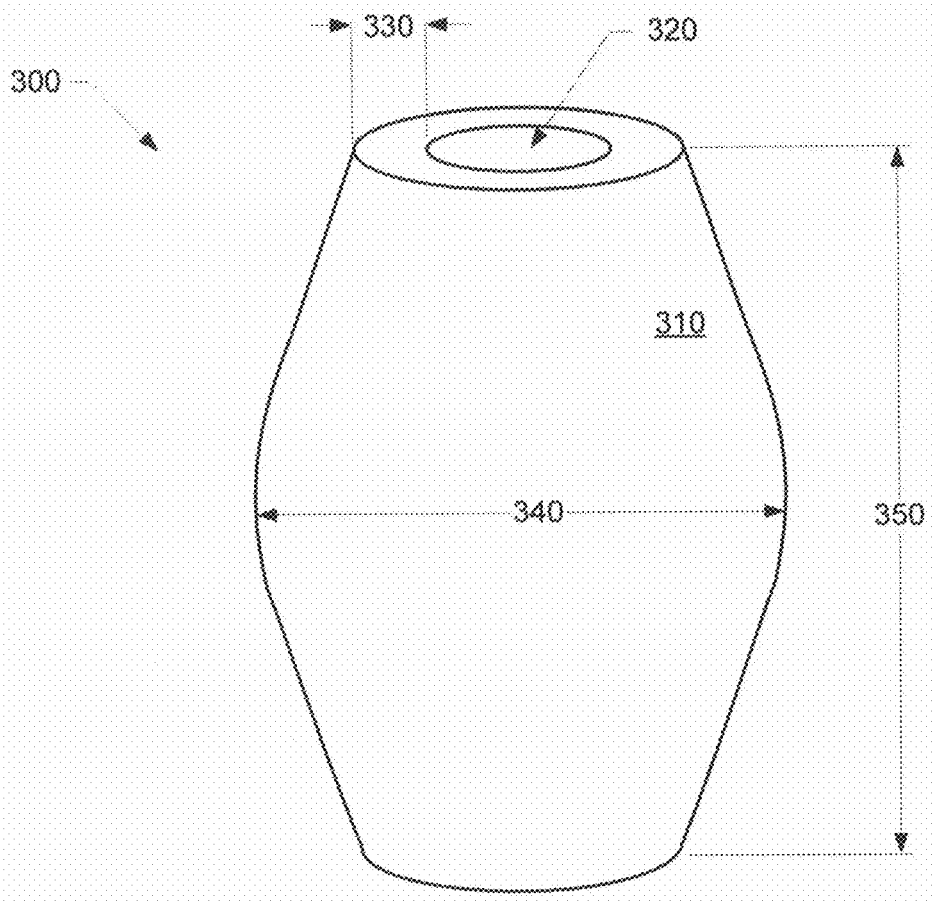
FIG. 3 depicts a plane view of an exemplary device to increase the buoyancy of a snorkel or a snorkel attached to a mask, in accordance with some embodiments of the present invention.

With reference to FIG. 1, a snorkel buoy 100 in accordance with some embodiments of the present invention will now be discussed. In general, snorkel 110 may be inserted into a buoy 120, which may be formed of various materials in various sizes and shapes as discussed above. Note that FIG. 1 illustrates a buoy with an elongated sphere, or oval shape. With reference to FIG. 3, a similar device 200 may be seen. Again, snorkel 210 may be inserted through buoy 220.

With reference to FIG. 3, a snorkel buoy 300 in accordance with some embodiments of the present invention will now be discussed. As noted, the snorkel buoy may be of any applicable size or shape. In general, snorkel buoy 300 may be comprised of a body 310 with an orifice 320 that penetrates through the body 310. During use, a snorkel may be inserted into the orifice 320 such that a portion of the snorkel is visible protrudes out of the top of the body 310. The orifice 320 may be of any size suitable to fit or cause an interference fit with a snorkel, though it is contemplated that an inner diameter of approximately one (1) inch may be utilized in some embodiments. The general width 340 of the snorkel buoy may also vary, although a range of two (2) to four (4) inches has been found to provide effective floatation without impacting the use of a mask or snorkel. The length 350 of the buoy may also vary, though a range of two (2) to five (5) inches has also been found to be effective. The thickness 330 of the snorkel buoy at the orifice may vary, provided the snorkel buoy maintains sufficient rigidity and/or structural integrity to be effective. Note that in the case of an inflatable buoy, the general sizes indicated above may not be applicable.

Figure 4:
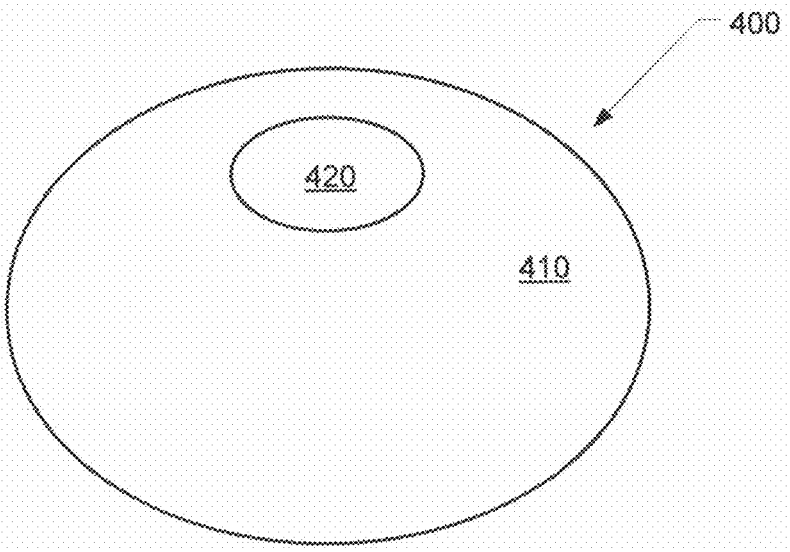
FIG. 4 depicts a plane view of an exemplary device to increase the buoyancy a snorkel or a snorkel attached to a mask, in accordance with some embodiments of the present invention.

With reference to FIG. 4, it is contemplated that a snorkel buoy 400 may also be in the shape of a donut. The body of the snorkel buoy 410 may extend laterally longer than the length of the buoy. Again, an orifice 420 may penetrate through the body 410.

Figure 5:
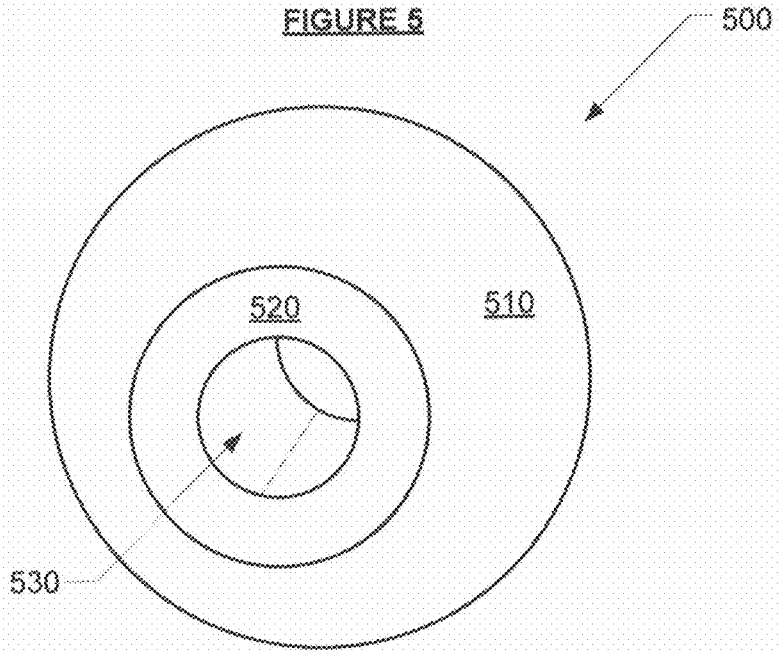
FIG. 5 illustrates an exemplary device comprised of multiple materials to increase the buoyancy of a snorkel or a snorkel attached to a mask, in accordance with some embodiments of the present invention.

With reference to FIG. 5, a snorkel buoy 500 may be comprised of multiple materials. For example, an outer material 510 may comprise the majority of the body and may be used to provide buoyancy or floatation. An inner material 520 may be used to provide an effective fit or interference fit with a snorkel, which may be inserted into orifice 530. For example, inner material 520 may be comprised of vinyl or neoprene, such that a snorkel inserted into orifice 530 may be snugly attached, even in wet conditions.

Figure 6:
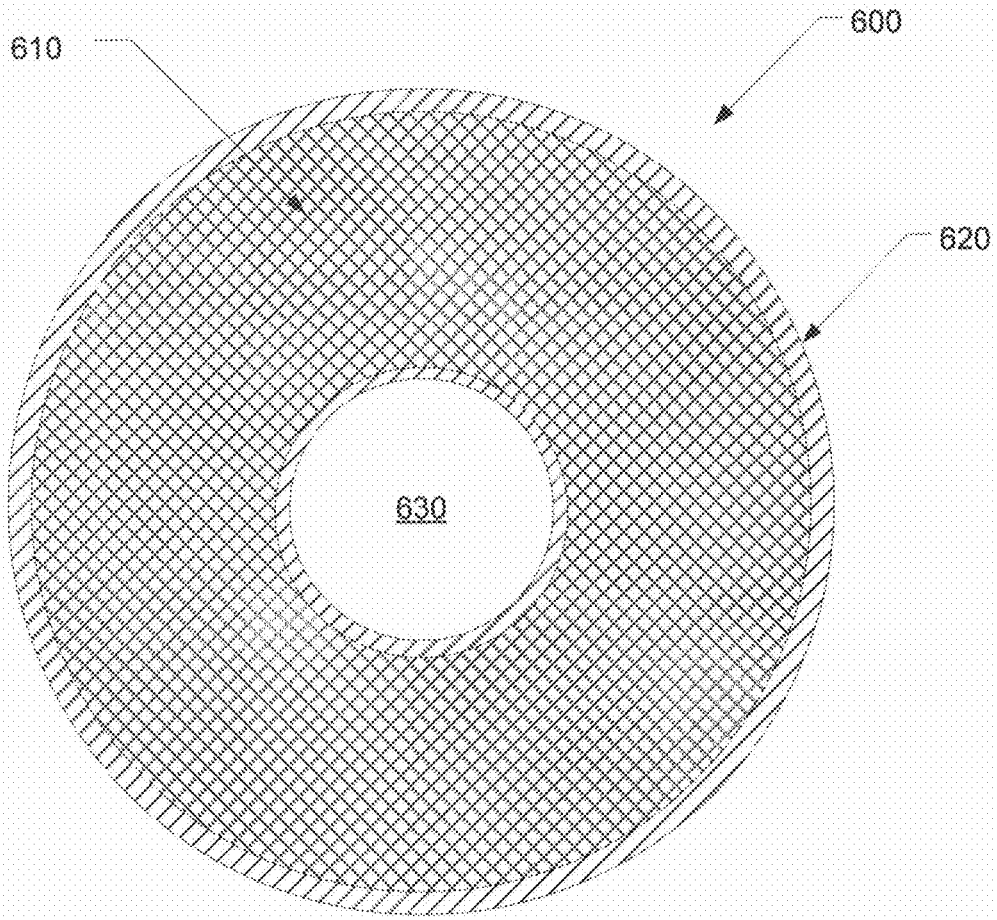
FIG. 6 illustrates an exemplary device comprised of multiple materials to increase the buoyancy of a snorkel or a snorkel attached to a mask, in accordance with some embodiments of the present invention.

With reference to FIG. 6, a cross-section of a snorkel buoy 600 that may be comprised of two (2) portions may be seen. In accordance with some embodiments, the snorkel buoy may be formed of a first material (such as, but not limited to, closed cell foam), that may be covered in a second material (such as, but not limited to, a waterproof vinyl coating). The body 610 of the snorkel buoy may be formed of the first material, while the covering 620 may be a second material. Note that the covering may extend into the orifice 630 to fully enclose and/or encase the body 610.

Figures 7A, 7B, 7C, 7D, 7E:
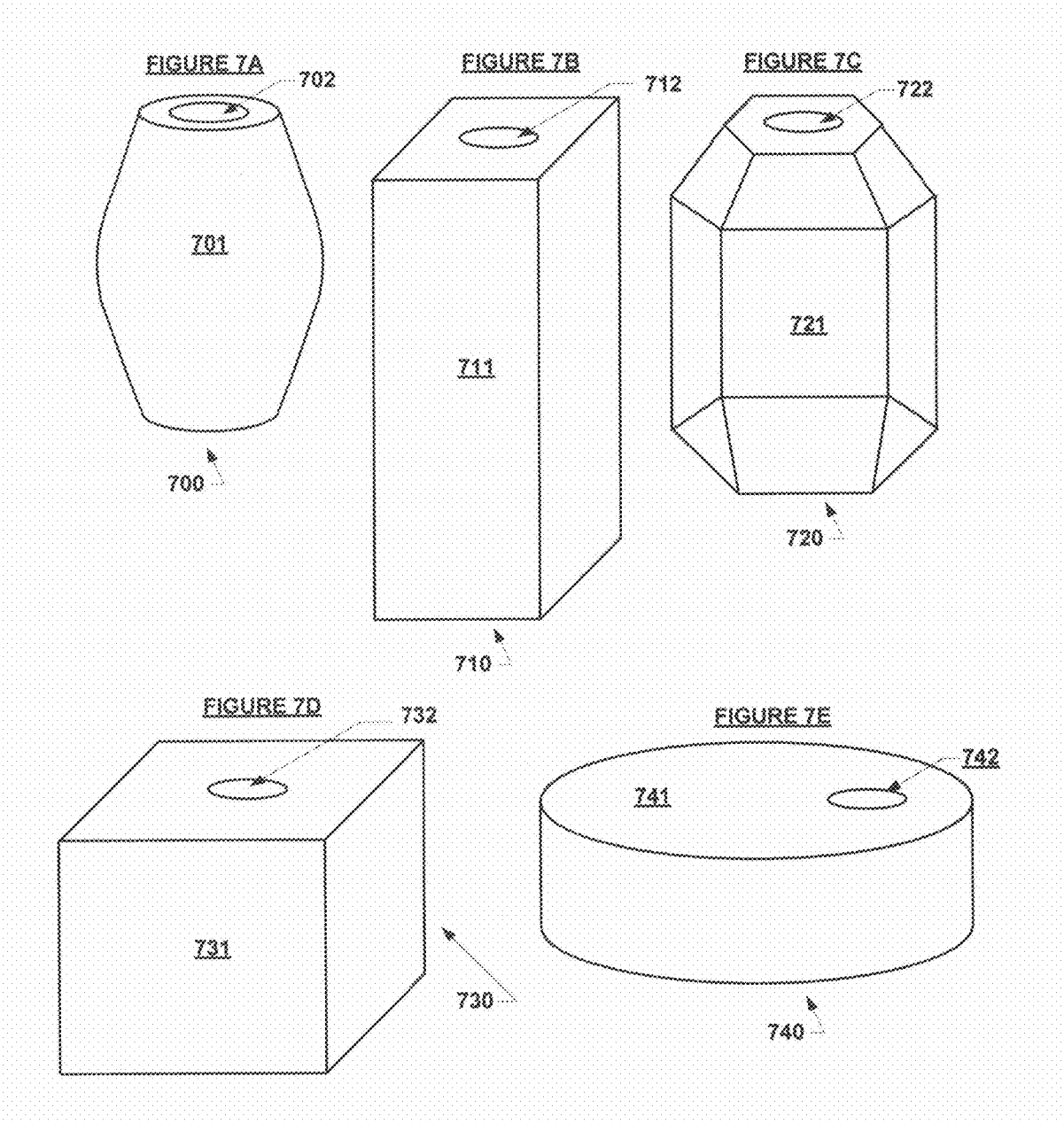
FIGS. 7*a*-7E depict an exemplary device, in a variety of shapes to increase the buoyancy of a snorkel or a snorkel attached to a mask, in accordance with some embodiments of the present invention.

With reference to FIGS. 7A-7E, a snorkel buoy may be in any suitable shape. FIG. 7A illustrates a snorkel buoy 700 in an elongated sphere, or oval shape, comprised of a body 701 and an orifice 702. FIG. 7B illustrates a snorkel buoy 710 in an elongated rectangular shape, comprised again of a body 711 and an orifice 712. FIG. 7C illustrates a snorkel buoy 720 in the prism shape, again comprising a body 721 and an orifice 722. FIG. 7D illustrates a snorkel buoy 730 in a cube shape, with a body 731 and an orifice 732. FIG. 7E illustrates cylinder shape 740 with a body 741 and an orifice 742. Note that these embodiments are exemplary only, and a snorkel buoy in accordance with the present invention may take any suitable shape.

With continued reference to FIG. 7E, note that the orifice is offset from the center of the snorkel buoy. While the orifice has been illustrated to be centered or coaxial with the body of the snorkel buoy, in accordance with some embodiments of the present invention the orifice may be offset or positioned not in line with the body of the buoy.

Figures 8, 9:
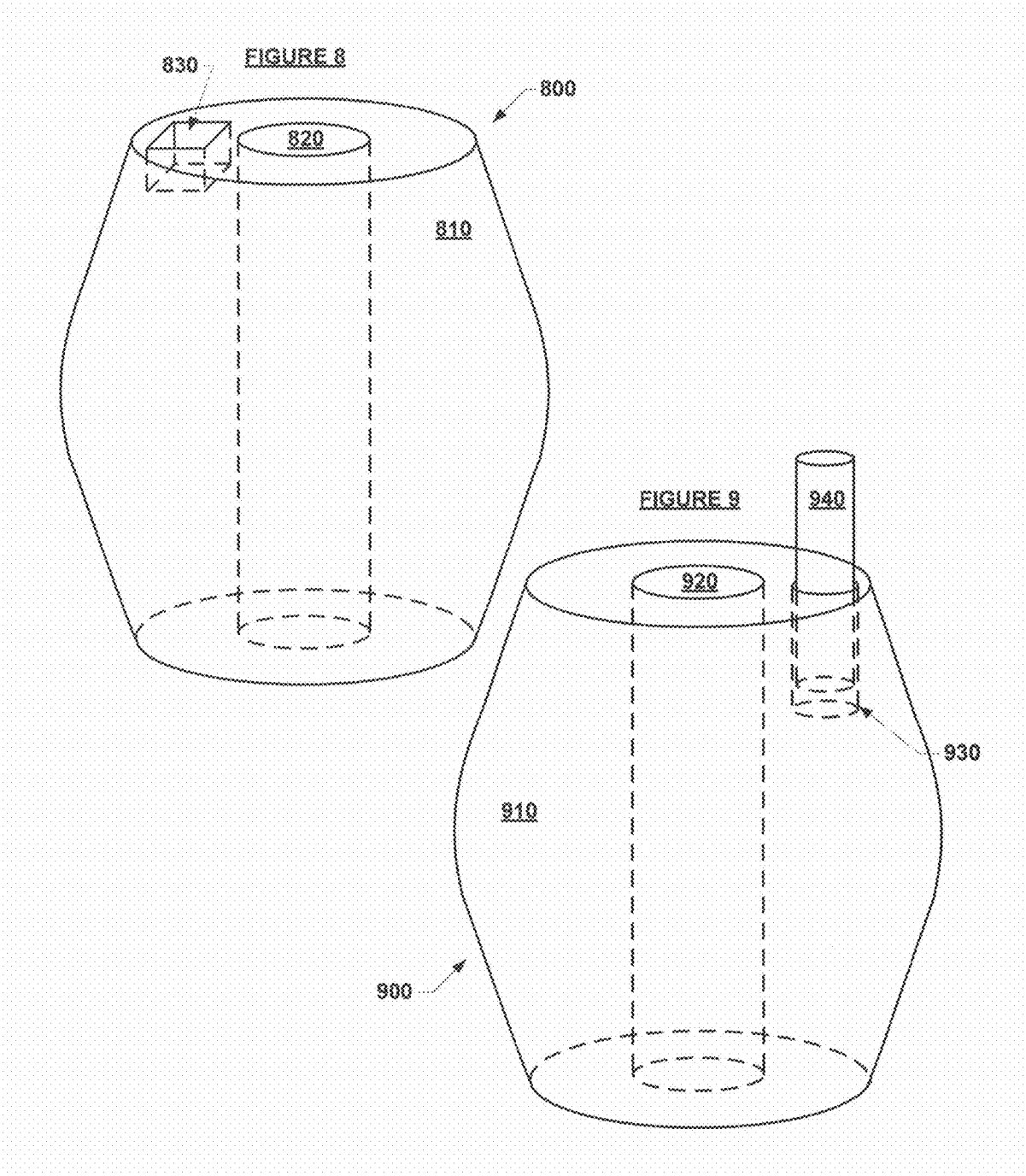
FIG. 8 illustrates an exemplary device to increase the buoyancy of a snorkel or a snorkel attached to a mask, including a cavity to receive an additional light component, in accordance with some embodiments of the present invention.
FIG. 9 illustrates an exemplary device to increase the buoyancy of a snorkel or a snorkel attached to a mask, including a cavity to receive an additional light component, in accordance with some embodiments of the present invention.

With reference to FIG. 8, a snorkel buoy 800 comprising a body 810 and an orifice 820 is again illustrated. In accordance with some embodiments of the present invention, the snorkel buoy 800 may also comprise a compartment 830 into which an additional light source, such as an LED may be inserted. S Similarly, with reference to FIG. 9, a snorkel buoy 900 may comprise a body 910 and an orifice 920, and may also comprise an additional depression or indention 930 into which a light source, such as a glow-stick 940, may be inserted. The indention 930 may be sized to provide an interference fit for a glow stick.

Figure 10:
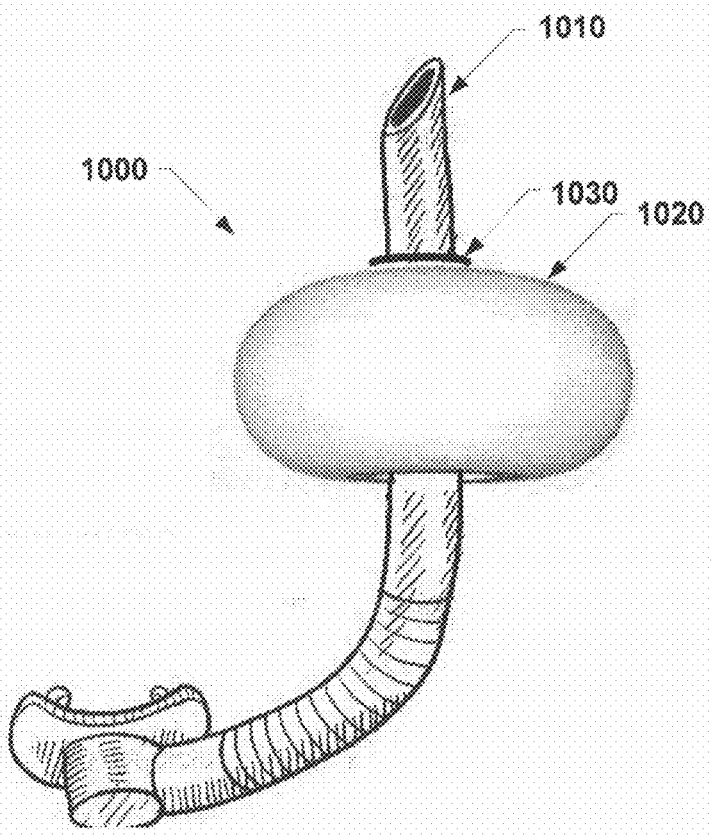
FIG. 10 illustrates an exemplary device attached to a snorkel to increase the buoyancy of a snorkel or a snorkel attached to a mask, the device including a mechanism to prevent the device from disengaging from the snorkel, in accordance with some embodiments of the present invention.

It is contemplated that the in addition to the interference fit discussed above, the snorkel buoy may be additionally attached to the snorkel. With reference to FIG. 10, snorkel buoy 1000 may comprise a snorkel 1010, a buoy 1020, and an additional component 1030. Additional component 1030 may be utilized to prevent the snorkel buoy from sliding up the snorkel 1010 and detaching. The additional component 1030 may comprise a snap ring, zip tie, strap, elastic, or any other device that may prevent the buoy 1020 from sliding up the snorkel 1010.

Figure 11:
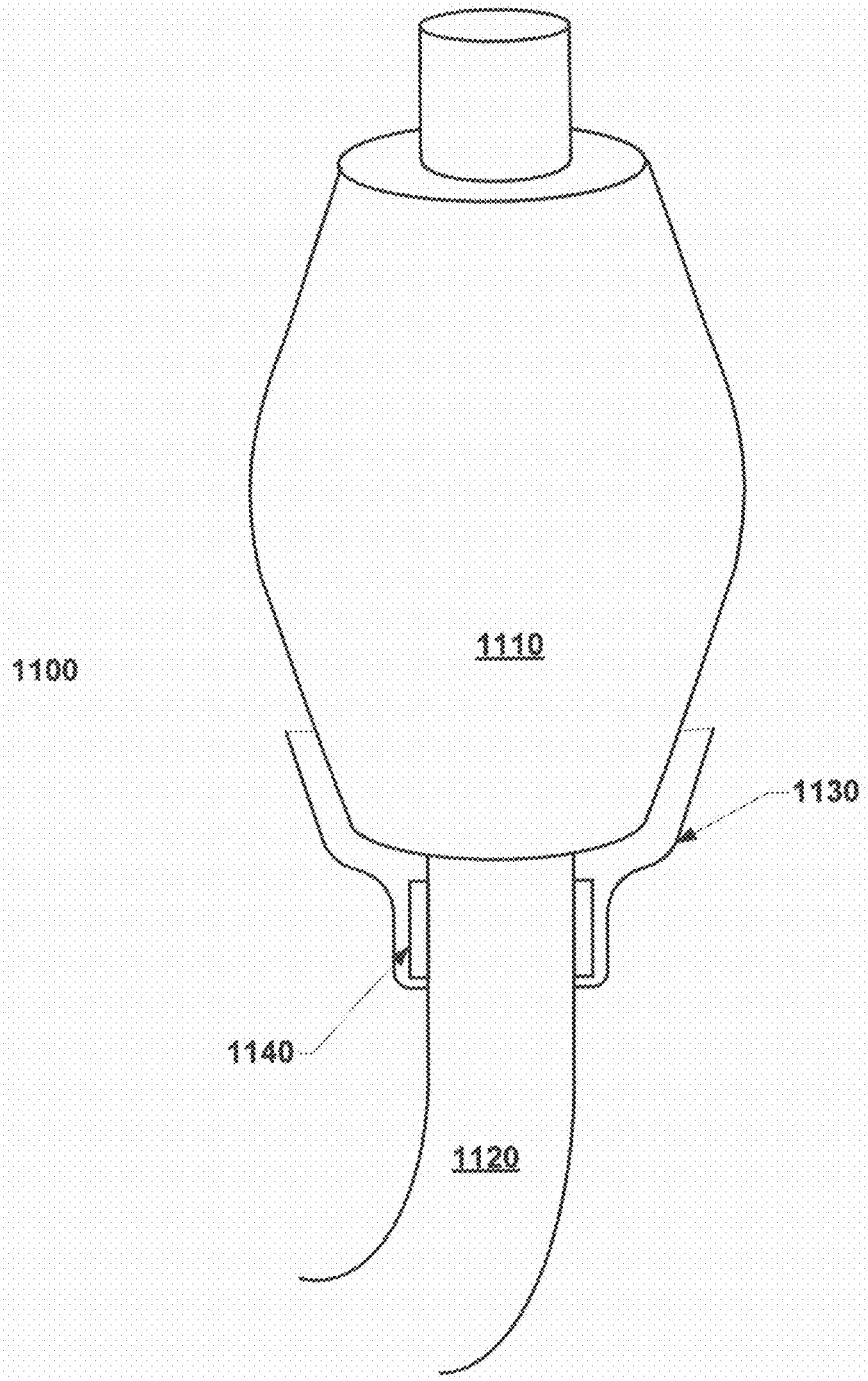
FIG. 11 illustrates an exemplary device attached to a snorkel to increase the buoyancy of a snorkel or a snorkel attached to a mask, the device including a mechanism to prevent the device from disengaging from the snorkel, in accordance with some embodiments of the present invention.

Similarly, with reference to FIG. 11, snorkel buoy 1100 may comprise a buoy 1110 and a snorkel 1120. The buoy 1110 may have one or more straps 1130 attached. Straps may be detachable attached (such as via snaps, hook-and-loop, zippers, buckles, etc.), or may be attached to the buoy 1110 by sewing or adhesive, or may be integrally made portions of an outer material.

Straps 1130 may attach to the snorkel 1120 using any suitable attachment 1140. Suitable attachment 1140 may include, for example, hook-and-loop attachment, snaps, magnets, elastic pulled tight around the snorkel, buckles, etc. Accordingly, buoy 1110 may be firmly connected to snorkel 1120 to prevent the buoy 1110 from inadvertently or unintentionally becoming separated from the snorkel.

It will be understood that the specific embodiments of the present invention shown and described herein are exemplary only. Numerous variations, changes, substitutions and equivalents will now occur to those skilled in the art without departing from the spirit and scope of the invention. Accordingly, it is intended that all subject matter described herein and shown in the accompanying drawings be regarded as illustrative only, and not in a limiting sense.

What is claimed is:

1. A floatation device for a snorkel, comprising:

a body, comprised of a buoyant material, the body providing buoyancy to the entire snorkel but not preventing an end of the snorkel from entering water;

an orifice penetrating through the body, the orifice sized to receive a snorkel; and wherein the buoyancy provided by the body does not hinder or negatively impact swimming of the user.

2. The floatation device of claim 1, wherein the buoyant material is comprised of closed cell foam.

3. The floatation device of claim 2, wherein the closed cell foam is selected from the group consisting of polyethylene foam, expanded polyethylene (EPE), polyethylene furanoate (PEF), cross-linked polyethylene (XPE), irradiation cross-linked polyethylene (IXPE), low density polyethylene (LDPE)), polypropylene and expanded polypropylene (EPP) foam, polystyrene or expanded polystyrene foam, polyurethane foam, polyvinylchloride foam, ethylene vinyl acetate (EVA) foam, and expanded polyolefin (EPO) foam.

4. The floatation device of claim 1, wherein the buoyant material is comprised of an inflatable material filled with air.

5. The floatation device of claim 1, wherein the orifice is sized to cause an interference fit with a snorkel inserted into the orifice.

6. The floatation device of claim 1, further comprising an indentation or compartment for receiving a light element.

7. The floatation device of claim 6, wherein the light element is a light emitting diode (LED) or a chemical luminescence stick.

8. The floatation device of claim 1, wherein the body is covered or wrapped in an additional material.

9. The floatation device of claim 8, wherein the additional material is waterproof.

10. The floatation device of claim 8, wherein the additional material is resistant to ultraviolet light and sunlight.

11. The floatation device of claim 1, wherein the body is formed of a brightly colored material.

12. The flotation device of claim 1, wherein the body is formed of material that glows in the dark.

13. The floatation device of claim 1, wherein the body includes a pattern printed, embossed, or emblazoned thereon.

14. The floatation device of claim 13, wherein the pattern is a diver down flag.

15. The floatation device of claim 1, wherein the device provides sufficient buoyancy to maintain a snorkel and mask in a floating position on a surface of water.

16. The floatation device of claim 1, wherein the body is attached to the snorkel via an attachment component.

17. The floatation device of claim 16, wherein the attachment component is selected from the group consisting of a snap ring, zip tie, elastic material, straps, snaps, hook-and-loop, magnets, and buckles.

18. A floatation device for a snorkel, comprising:

a body, comprised of a first material wrapped in a second material, wherein the first material is buoyant and provides buoyancy to the snorkel that does not hinder or negatively impact swimming or diving of a user, and the second material is brightly colored; and an orifice penetrating through the body, the orifice sized to receive a snorkel and cause an interference fit with the snorkel.

19. A floatation device for a snorkel, comprising:

a body, comprised of a buoyant material, the body providing buoyancy to the entire snorkel but not preventing an end of the snorkel from entering water, the body attached to the snorkel by a snap ring, zip tie, elastic material, straps, snaps, hook-and-loop, magnets, or buckles;

an orifice penetrating through the body, the orifice sized to receive a snorkel; and wherein the buoyancy provided by the body does not hinder or negatively impact swimming of the user.

* * * * *